US007489242B2

(12) United States Patent
Hines et al.

(10) Patent No.: US 7,489,242 B2
(45) Date of Patent: Feb. 10, 2009

(54) RFID MULTIPLE RANGE METHOD AND SYSTEM

(76) Inventors: Tony Hines, 550 N. Reo St., Suite 300, Tampa, FL (US) 33609-1065; Steven Hill, 4505 S. Shamrock Rd., Tampa, FL (US) 33611; Dennis Lusk, 16540 Willow Glen Dr., Odessa, FL (US) 33556

( * ) Notice: Subject to any disclaimer, the term of this patent is extended or adjusted under 35 U.S.C. 154(b) by 0 days.

(21) Appl. No.: 11/180,482

(22) Filed: Jul. 13, 2005

(65) Prior Publication Data

US 2006/0033623 A1 Feb. 16, 2006

Related U.S. Application Data

(60) Provisional application No. 60/588,033, filed on Jul. 13, 2004.

(51) Int. Cl.
*G08B 13/14* (2006.01)

(52) U.S. Cl. ..... 340/572.1; 340/568.1; 340/572.4

(58) Field of Classification Search ..... 340/572.1
See application file for complete search history.

(56) References Cited

U.S. PATENT DOCUMENTS 4,918,425 A * 4/1990 Greenberg et al. ..... 340/539.3
5,082,364 A * 1/1992 Russell ..... 356/5.15
5,402,116 A * 3/1995 Ashley ..... 340/870.1
5,936,527 A * 8/1999 Isaacman et al. ..... 340/572.1
6,046,683 A * 4/2000 Pidwerbetsky et al. ..... 340/10.4
6,456,239 B1 * 9/2002 Werb et al. ..... 342/463
2002/0158751 A1 * 10/2002 Bormaster ..... 340/10.2
2004/0112957 A1 * 6/2004 Elledge ..... 235/382
2004/0263388 A1 * 12/2004 Krumm et al. ..... 342/451
2006/0012476 A1 * 1/2006 Markhovsky et al. .. 340/539.32

* cited by examiner

*Primary Examiner*—Charles D. Garber
*Assistant Examiner*—Kerri L McNally
(74) *Attorney, Agent, or Firm*—Matthew G. McKinney; McKinney Law, LLC

(57) ABSTRACT

The present invention is a method and system for determining the range of an RFID tag from an origin using radio-frequency identification ("RFID") tags. An RFID tag with a unique numerical identifier is secured to an object. The RFID tag transmits its unique numerical identifier using RF signals, wherein the numerical identifier further comprises an array of extensions. The strength of each of the RF signals corresponds to an extension of the array of extensions. A receiver reads the RF signals and determines the unique numerical identifier and extensions being transmitted. An information processor interconnected with the receiver analyzes the unique numerical identifier and extensions from a predetermined index, and the information processor determines the range of the identity and range of the RFID tag from an origin.

14 Claims, 2 Drawing Sheets

EXTENSIONS ARRAY TRANSMITTED BY RFID TAG

| Numerical Identifier | Extension | RF Signal Strength (relative) | Encoded Information |
|---|---|---|---|
| 275 | 10 | LOW | 275-10 |
| 275 | 50 | | 275-50 |
| 275 | 100 | | 275-100 |
| 275 | 150 | HIGH | 275-150 |

| EXTENSIONS ARRAY TRANSMITTED BY RFID TAG | | | |
|---|---|---|---|
| **Numerical Identifier** | **Extension** | **RF Signal Strength (relative)** | **Encoded Information** |
| 275 | 10 | LOW | 275-10 |
| 275 | 50 | ↓ | 275-50 |
| 275 | 100 | ↓ | 275-100 |
| 275 | 150 | HIGH | 275-150 |

RFID MULTIPLE RANGE METHOD AND SYSTEM

CROSS-REFERENCE TO RELATED APPLICATIONS

This application claims the benefit of U.S. Provisional Application No. 60/588,033 filed Jul. 13, 2004. The disclosure of the provisional application is incorporated herein by reference.

BACKGROUND OF THE INVENTION

1. Field of the Invention

The present invention relates to radio frequency identification, and more specifically to a method and system using radio frequency identification tags to determine the specific location of an object from an origin.

2. Description of the Prior Art

Object management applications exist in which objects of concern are tracked by a company or group. Examples of such objects of concern include the tools carried on fire engines, the fire engine itself and the firefighter. The objects are typically grouped together into a set depending on the task at hand.

Often times a mobile platform is used for storing and transporting objects of concern. For example, a cart for surgical instruments or a fire engine can provide a mobile platform. The mobile platform is transported to a remote destination where the tools are used to carry out a function or perform a task. Upon arrival at the remote destination, missing objects such as critical tools can cause severe problems in performing the necessary task. In addition, without an adequate method and system to monitor the objects, the mobile platform may return to its origination point without all the tools or objects of concern.

Some object management systems use bar codes that are affixed to the objects. In a typical example of such a system, an operator uses a hand-held bar code scanner to read the bar code on the objects. The bar code is read as the objects are loaded into the mobile platform before being transported to a remote destination where a function or task is performed. The bar codes are read again as the objects are unloaded upon returning from the remote destination. Such a system requires that all equipment be loaded and offloaded each time the mobile location performs a task or function. For mobile locations carrying hundreds of objects, this operation is time-consuming. In addition, missing tools are not identified until the mobile platform has returned from a remote site.

Various radio-frequency identification ("RFID") tag systems have been used in object management in the past and are currently in use. A typical system includes an RFID tag that provides non-volatile memory for storing information and a means well known in the art for interacting with an interrogator. The RFID tags contain identifier information associated with the particular objects to be managed and are attached to the objects. The RFID interrogator is used to detect the presence of an RFID tag and to read the information stored on the RFID tag. A typical RFID interrogator includes an RF transceiver for transmitting interrogation signals to the RFID tag and receiving response signals from RFID tags. The interrogator also includes one or more antennae connected to the transceiver and associated decoders and encoders for reading and writing the encoded information in the received and transmitted RF signals, respectively. After detecting a RFID tag attached to an object, an information processing unit associated with the interrogator determines that the object is present, and updates a database accordingly. However, the prior art RFID systems do not have the ability to provide a management system that allows a user to monitor the tools at a remote destination or to automatically alert a user when tools are missing or to determine the specific location of an object from an origin.

It is desirable to provide a system and method that provides full automation for the identification and management of tools of the trade on mobile platforms. There is a need for such a system that is adaptable for use with all of the wide variety of mobile platforms, such as police, fire and emergency vehicles, or individual users who must take a set of tools to a remote destination to perform a task and then return. There is also a need for such a system that provides information on both the presence of an object and its location.

However, in view of the prior art at the time the present invention was made, it was not obvious to those of ordinary skill in the pertinent art how the identified needs could be fulfilled.

SUMMARY OF THE INVENTION

The invention provides for the detection of the range between an RFID tag and a receiver. One embodiment of the invention comprises a method for securing RFID tags each with a unique numerical identifier to a plurality of objects, wherein each numerical identifier further comprises an array of extensions, transmitting the unique numerical identifier associated with each of the RFID tags using a RF signal, wherein the RF signal is transmitted at different intervals for each of the RFID tags, receiving the RF signals at a designated location, reading the RF signals and determining the unique numerical identifier and extensions being transmitted by each of the RFID tags, analyzing the extensions for a corresponding distance of an object from a predetermined origin, determining the specific location of an object from the origin, determining whether any tools were not found on an index, and alerting a user when an object is missing.

In one embodiment of the invention, workers in a large space such as a warehouse wear badges with RFID tags. Each RFID tag has a unique numerical identifier such as "275." The numerical identifier also has number of extensions that correspond to distances, such as "10", "50", "100" and "150" to comprise an array of "275-10", "275-50", "275-100" and "275-150." Accordingly, "275-50" is equivalent to numerical identifier 275 at a distance of 50 feet from a predetermined origin. Each extension for the numerical identifier is associated with a specific RF signal strength. The badges transmit their encoded information at various times. A receiver situated at a fixed location within the warehouse will receive the RF signals transmitted from the RFID tags. However, the predetermined origin can be either a fixed location or a transient location. The RF signal level received from the RFID tags is a function of the distance between the RFID tag and the receiver so that the larger the distance between the RFID tag and the receiver, the lower the signal level. RF signal level is roughly proportional to the inverse square of the distance between the RFID tag and the receiver. The receiver can programmatically modify its sensitivity to RF signals so that it can control the area from which it can receive information from the RFID tags.

In another embodiment of the invention, a RFID tag, for example, with a numerical identifier of "111" is located at a distance of ten (10) feet from the receiver, and another RFID tag with a numerical identifier of "112" is located at a distance of eighteen (18) inches. The RFID receiver is mounted at the door of a room that is of predetermined size, say approximately twenty (20) feet in length and width. Accordingly, the receiver's sensitivity to RF signals is initially adjusted so that it can receive data from up to twenty (20) feet away. The receiver reads information from RFID tags "111" and "112" and adjusts its range to "less than twenty (20) feet." The receiver subsequently and programmatically adjusts its sensitivity such that only RFID tags closer than two (2) feet are received. Accordingly, the receiver detects only the RFID tag numerical identifier "112" and sets its range for RFID numerical identifier "112" as "less than two (2) feet", and the range for RFID tag numerical identifier "111" as "less than twenty (20) feet and more than two (2) feet." A building security system, recognizing that RFID numerical identifier "112" is within two feet of the door, and determining that RFID numerical identifier "112" is authorized to pass through the door, the door is automatically unlocked and opened. The receiver continuously stores and time stamps the information received from the RFID tags so that the movement of the RFID tags and the objects that they are attached to can be tracked using in an economical manner.

In another embodiment, the receiver is used to determine the location of the RFID tag so that telephone calls can be forwarded to a specific employee wearing a badge with a RFID tag without paging the entire building.

In another embodiment of the present invention, a receiver has two (2) sensitivities, such as "near" and "far" to describe the distance of the RFID tag from a receiver. Accordingly, the receiver categorizes an RF signal as "near" or "far" based on the power of the RF signal received. Thus, for example, when an object with an RFID tag is relocated from one monitored room to another, the RFID receiver in the previous room will determine that the object is "far" based on the weakness of the RF signal. The receiver in the room now occupied by the object with the RFID tag detects and identifies the tag as "near" based on the strong RF signal. In this way, the receiver can determine the presence of an RFID tag in its vicinity, and distance of an RFID tag to the receiver.

In another embodiment of the invention, a predetermined set of surgical tools required for a particular surgical procedure is gathered together on a cart and transported to an operating room. An information processor (e.g., a handheld computer) and RFID receiver are also present on the cart. Each of the tools to be used in the procedure has an attached RFID tag. The information processor contains an electronically stored index of the tools required to be present for the particular surgical procedure, and alerts the user if any necessary tool is missing prior to transporting the cart, i.e., mobile platform, to the operating room. During the surgical procedure, the information processor monitors the use of the tools. When the procedure is completed, the information processor alerts the user if any surgical tool has not been returned to the cart. In this manner, the system ensures that all required tools are present prior to beginning the surgery, and prevents mistakes such as inadvertently leaving a surgical tool in a patient after the surgical procedure.

In another embodiment of the invention, each RFID tag contains a unique identification number (identifier signal) that can be cross-referenced by the information processor to a particular piece of equipment or tool on an electronically stored index. The RFID tags transmit their information at times that are randomly distributed about some mean interval, for example 30 seconds. Thus, in this example, each RFID tag transmits its identifier signal on average twice every minute. Since the time taken to transmit the information is small relative to the average time interval between transmissions, the probability that the transmission of two or more RFID tags will overlap in time is negligible. Since the RF signals transmitted by the tags are low power, the RFID receiver will only detect RFID tags when they are in proximity to the receiver. For example, when a tool is removed a pre-determined distance from the mobile platform, the RFID receiver will no longer detect the signal from its tag and the information processor will alert the user that a tool is missing.

The information processor is interconnected to the RFID receiver for processing the signals received from the RFID tags and determining the identity of the objects to which the RFID tags are attached using an electronically stored index. The information processor may be located on the mobile platform or at a remote destination and interconnected with the receiver through a wireless connection, or a combination of both.

In another embodiment of the invention, a user interface provides users on the mobile platform with information on the current state of the inventory of tools of the trade on the mobile platform. For example, the user interface may show a list of tools available on the mobile platform using a screen. The information processor may further be configured to provide audible or visible warnings when certain vital tools are not available on the mobile platform.

The information processor may also send information, such as the current status of the inventory on the mobile platform to another system wide information processor at a central site. This system wide information processor may then maintain inventory information on more than one set of tools of the trade on a plurality of mobile platforms.

In another embodiment of the invention, a plurality of RFID receivers on the mobile platform are each interconnected with a single information processor. In this way the location of various tools on the mobile platform may be grouped together or divided into a number of zones for easier location of specific tools. One or more of these RFID receivers may be removable from the mobile platform in order to maintain inventory information on tools that are temporarily in use at a remote destination from the mobile platform.

The information processor is also capable of providing information to users aboard a mobile platform as to the state of the inventory of the tools of the trade. This information may include lists of the tools available on the mobile platform and audible and/or visible warnings when vital tools are not available.

In another embodiment of the invention, one or more of the receivers may be removable from the mobile platform while remaining interconnected to the information processor through a wireless connection.

In another embodiment of the invention, a plurality of information processors on a plurality of mobile platforms are interconnected to a single system wide information processor at a central site. In this way an inventory of tools to be used on a plurality of mobile platforms can be automatically managed and controlled.

The specific embodiments described above provide a fully automated method and system for managing objects and determining the locations of object from a predetermined origin in an economical manner. A primary object of the invention is to provide immediate feedback to the user of the mobile platform as to the availability of all necessary tools to carry out the proposed task, and the presence of all tools at the completion of the task prior to returning from the remote destination. Thereby the possibility for error or loss is minimized.

Another very important object of the invention is to provide a system and method that is adaptable for use with all of the wide variety of mobile platforms that might exist.

Still another important object is to provide a system and method can operate in conjunction with a system wide information processor and can manage and monitor all tools used by a number of distinct mobile platforms. By using the invention, mobile platforms will arrive at the remote destination with the full set of tools required to carry out the task or function and tool losses will be greatly reduced.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
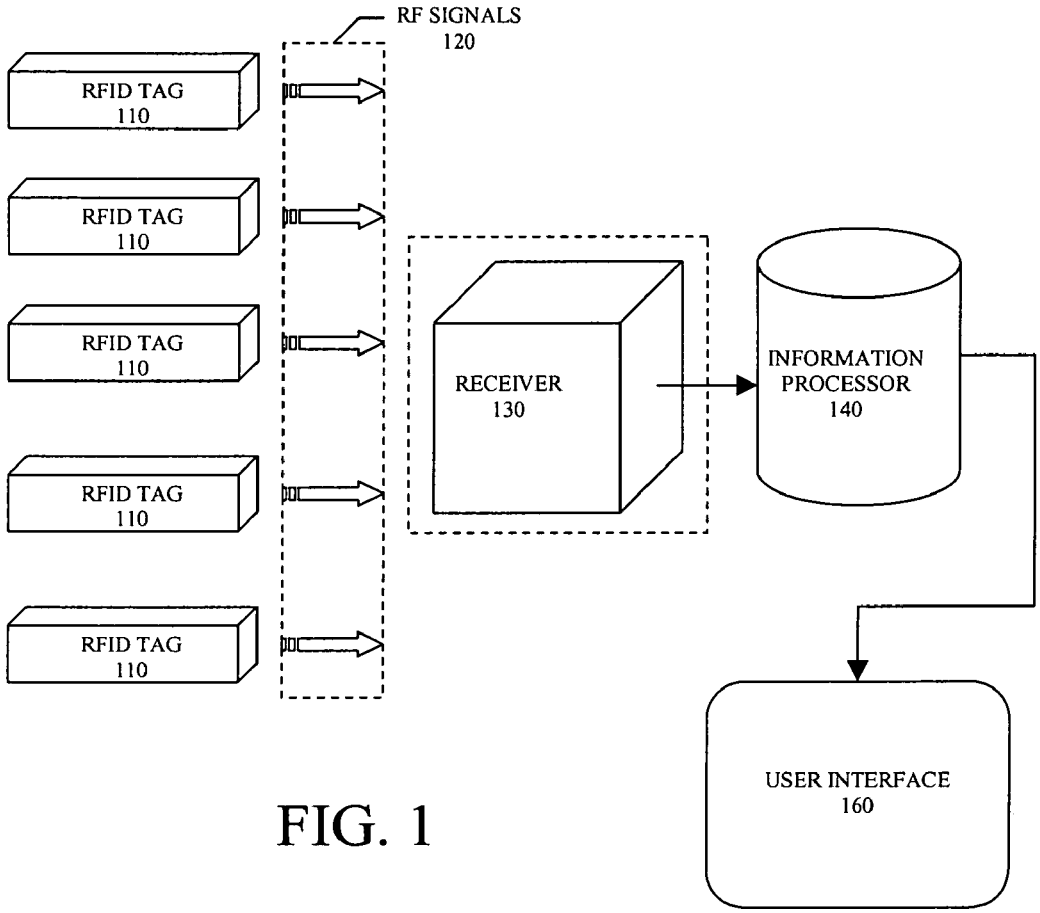
FIG. 1 is a block diagram view of an embodiment of the system.

Referring to FIG. 1, in one embodiment of the invention each RFID multiple range tag 110 is attached in a semi-permanent manner to the desired object. The identifier information of the RFID tag 110 and an index regarding the object to which the tag is attached is provided in a database electronically stored on the information processor 140. The RFID tags 110 that are attached to the desired objects transmit their identifier information using RF signals 120 to a receiver 130 at an origin location.

The receiver 130 is interconnected to the information processor 140. In this manner the information processor 140 is continually and automatically monitoring the identifier information of all of the RFID tags 110 that are within RF reception range of the receiver 130 located at an origin. The information processor 140 analyzes and determines the spatial location of each RFID tag 100 from the receiver 130 based on the RF signals 120 received.

Using the information collected from the receiver 130 and the information stored in an index or database, the information processor 140 presents information about the objects to a user via a user interface 160. Examples of such information might include lists of objects available on the user interface 160 or audible and/or visible warnings when certain crucial objects or tools are not present. The information processor 140 may be connected through a wireless link, for example WLAN or cellular telephone, so that users at a remote location may in informed as to the state of the inventory of tools.

Figure 2:
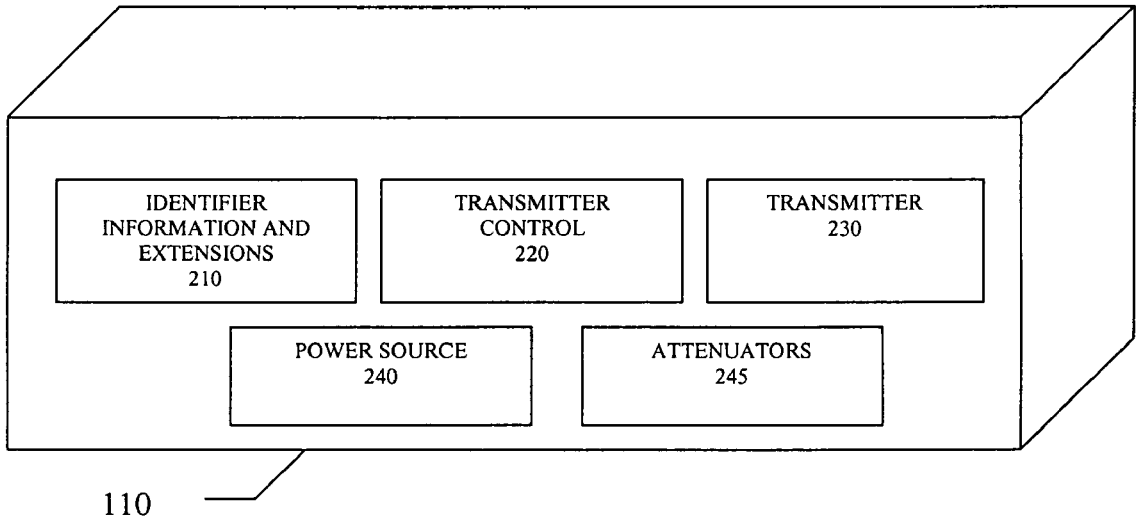
FIG. 2 is a block diagram view of an embodiment of a RFID multiple range tag for use with the system.

Referring to FIG. 2, each RFID tag 110 contains unique identifier information 210 and transmitter 230 to transmit the identifier information 210 using an RF signal. Identifier information 210 further comprises extensions that correspond to a predetermined distance and strength of an RF signal. A plurality of attenuators 245 are provided so that the appropriate strength of an RF signal via its respective attenuator is associated with each extension. The strength of the RF signals 120 range from a relatively low power to high power. The RFID tag 110 transmits its RF signals through the attenuators 245 and if the receiver 130 receives the low power RF signals then it is determined by the information processor 140 that the RFID tag 110 is in close proximity. If the receiver 130 only receives RF signals associated with the high power RF signal and respective extension, then it is determined by the information processor 140 that the RFID tag 110 is a particular distance from the origin associated with that extension.

Each RFID tag 110 also contains a transmitter control means 220 well known in the field by which the RF signals are transmitted at a time interval that is randomly distributed about some average value. Alternatively, the time interval is predetermined. This reduces the probability of two or more RFID tags 110 transmitting their identifier information 210 during the same time causing interference. The transmitter 230 is omni-directional. Each RFID tag 110 also contains a power source 240 that allows the RFID tag 110 to transmit its information on a regular basis for a long period of time, for example five years, without replacement.

Figures 3, 4:
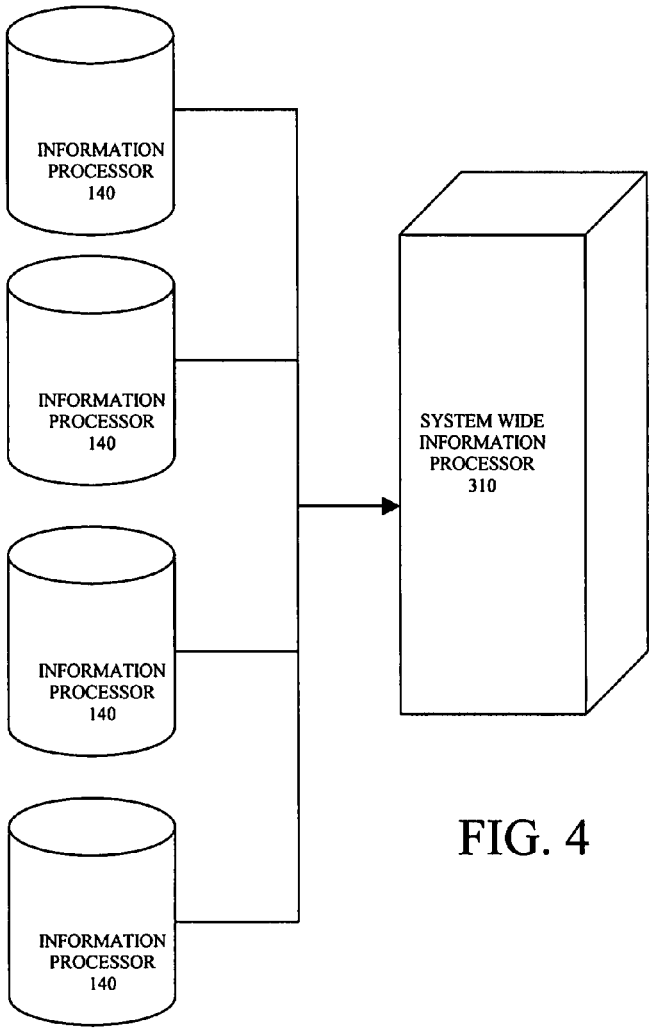
FIG. 3 is a table illustrating an extensions array transmitted by a RFID multiple range tag for use with the system.
FIG. 4 is a block diagram view of another embodiment of the system illustrating a system wide information processor.

Referring to FIG. 3, an array of extensions is used with each numerical identifier. Each extension corresponds with a specific RF signal strength controlled by its respective attenuator. The numerical identifier and extension is encoded and transmitted. The RF signals are received by the receiver and the information processor determines the distance between the RFID tag and a point of origin of the receiver. The receiver may be mobile as with a hand held receiver so that the origin is variable. The particular extensions are predetermined by a user as to the degree of accuracy required. For example, extensions could correspond to large intervals such as fifty (50) feet as shown in FIG. 3 or more discrete intervals such as five (5) feet. It is in the discretion of the user to determine the spatial intervals.

Referring to FIG. 4, there may be a number of information processors 140 corresponding to a particular set of tools with each information processor 140 interconnected to a system wide information processor 310, whereby inventory control and management of tools or objects can be facilitated. The system wide information processor 310 may be connected to each of the local information processors 140 through a number of different means such as a local area network or through a wireless link.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

Now that the invention has been described,

What is claimed is:

1. A method for determining the range of an RFID tag from an origin, the method comprising:

securing an RFID tag with a unique numerical identifier to an object wherein the numerical identifier further comprises an array of extensions wherein each extension corresponds to a predetermined spatial range from an origin;

transmitting the unique numerical identifier associated with the RFID tag using RF signals wherein the strength of each of the RF signals corresponds to a particular extension of the array of extensions;

receiving the RF signals at a designated location;

reading the RF signals and determining the extension from a predetermined index being transmitted by the RFID tag and determining the range of the RFID tag from an origin;

reading the RF signals and determining the unique numerical identifier being transmitted by the RFID tag;

analyzing the unique numerical identifier for a corresponding identification of an object from a predetermined index;

determining whether the object was not found on the index; and alerting a user when an object is missing.

2. The method of claim 1 wherein the RF signals are transmitted intermittently in short predetermined intervals.

3. The method of claim 2 wherein the origin is a transient location of a hand held receiver.

4. The method of claim 2 wherein the origin is a fixed location.

5. The method of claim 1 wherein the RFID tag contains an independent power source.

6. The method of claim 1, and further comprising:

receiving RF signals from a plurality of receivers wherein the receivers are interconnected to an information processor.

7. The method of claim 6, and further comprising:

providing a plurality of information processors wherein each information processor is interconnected to a system wide information processor.

8. A system for determining the range of an RFID tag from an origin, the system comprising:

an RFID tag with a unique numerical identifier secured to an object wherein the numerical identifier further comprises an array of extensions wherein each extension corresponds to a predetermined spatial range from an origin;

a transmitter for transmitting the unique numerical identifier associated with the RFID tag using RF signals wherein the strength of each of the RF signals corresponds to a particular extension of the array of extensions;

a receiver for receiving the RF signals at a designated location; and an information processor for analyzing the unique numerical identifier being transmitted by the RFID tag and for reading the RF signals to determine the extension from a predetermined index being transmitted by the RFID tag for determining the range of the RFID tag from an origin.

9. The system of claim 8 wherein the RF signals are transmitted intermittently in short predetermined intervals.

10. The system of claim 9 wherein the origin is a transient location of a hand held receiver.

11. The system of claim 9 wherein the origin is a fixed location.

12. The system of claim 8 wherein the RFID tag contains an independent power source.

13. The system of claim 8, and further comprising:

a plurality of receivers interconnected to an information processor for receiving RF signals.

14. The method of claim 13, and further comprising:

a plurality of information processors interconnected to a system wide information processor.

* * * * *